US005247911A

United States Patent [19]

Nenicka

[11] Patent Number: 5,247,911

[45] Date of Patent: Sep. 28, 1993

[54] COMPRESSION RATIO CONTROL IN GASOLINE ENGINES

[76] Inventor: Vratislav Nenicka, 2362 Haymaker Rd., Monroeville, Pa. 15146

[21] Appl. No.: 780,620

[22] Filed: Oct. 23, 1991

[51] Int. Cl.[5] ..... F02B 75/04

[52] U.S. Cl. ..... 123/48 B; 123/78 E

[58] Field of Search ..... 123/48 R, 48 B, 78 R, 123/78 BA, 78 B, 78 E, 197.4

[56] References Cited

U.S. PATENT DOCUMENTS

| | | | |
|---|---|---|---|
| 3,200,798 | 8/1965 | Mansfield | 123/78 B |
| 3,450,111 | 6/1969 | Cronstedt | 123/78 B |
| 3,450,112 | 6/1969 | Bachle | 123/78 B |
| 3,777,724 | 12/1973 | Kiley | 123/78 B |
| 4,079,707 | 3/1978 | Karaba et al. | 123/78 B |
| 4,784,093 | 11/1988 | Pfeffer et al. | 123/48 B |
| 4,785,790 | 11/1988 | Pfeffer et al. | 123/78 B |
| 4,809,650 | 3/1989 | Arai et al. | 123/78 B |

FOREIGN PATENT DOCUMENTS

| | | | |
|---|---|---|---|
| 1132039 | 12/1984 | U.S.S.R. | 123/78 BA |
| 2203817 | 10/1988 | United Kingdom | 123/78 AA |

*Primary Examiner*—David A. Okonsky

[57] ABSTRACT

A compression ratio control system consists of a two-part piston forming a hydraulic chamber between the two slidable parts; their relative position, which determines the piston height, is controlled outside of the engine by regulating the pressure of engine oil going to the crankshaft and channeled to the hydraulic chamber through the crank mechanism. Piston height adjustment is accomplished incrementally by balancing the oil pressure against the momentary cylinder pressure transmitted to the hydraulic chamber, for a short interval at a predetermined angular crankshaft position, using a timing device located at the crankshaft end of a piston rod. The timing device consists of a set of small valves operated by inertial forces; with respect to the oil flow, these valves are arranged in series and on different timing given by their angular orientation, so as to open the oil passage during their opening overlap once per cycle.

8 Claims, 4 Drawing Sheets

COMPRESSION RATIO CONTROL IN GASOLINE ENGINES

This patent application is based on Disclosure Document No. 238136, filed in the Patent Office under the Disclosure Program on Oct. 27, 1989.

BACKGROUND OF THE INVENTION

1. Field of the Invention

The invention relates to gasoline engines in which the expansion ratio and fuel efficiency at partial loads can be substantially enhanced by adapting the size of the compression clearance space to the momentary cylinder charge. The concept disclosed here is believed to be most suitable for application with electronically controlled four-stroke gasoline engines, although some of its elements can be utilized in the general technical field.

2. Description of the Prior Art

Engines with variable compression ratio were originally built for fuel testing and research purposes. They are single-cylinder and stationary; their mode of varying the compression ratio does not lend itself for use on modern multi-cylinder vehicular engines.

A multitude of patents emerged in the last six decades proposing solutions to the problem of varying the compression ratio by changing the height of two-part pistons so as to reach a substantially constant maximum pressure in the cylinder. U.S. Pat. No. 2,742,027 takes advantage of the inertial and hydraulic forces acting upon parts of the reciprocating piston assembly for incrementally raising a telescoping piston crown, conveniently using engine oil from the lubricating system as a hydraulic fluid which is forced through one-way valves in and out of the space between the two parts of the piston. After reaching the appropriate height corresponding to the size of the cylinder charge, the excess fluid is discharged into the oil pan through a spring-loaded pressure relief valve when the cylinder pressure reaches its peak.

A number of patents follow on the same principle, improving on the design of the valves and other mechanical parts, adapting the piston for two-cycle engines (U.S. Pat. No. 3,200,798), adding compensation for engine speed (U.S. Pat. No. 3,205,878), oil filtering means (U.S. Pat. No. 3,417,738), bubble removal (U.S. Pat. No. 3,656,412), improving access to the hydraulic valves (U.S. Pat. No. 4,241,705), adding temperature-sensitive variation (U.S. Pat. No. 4,979,427).

U.S. Pat. No. 4,687,348 takes a different approach—it provides a choice between two piston heights (two pre-set compression ratios) by means of an excentric piston pin bearing; switching between the two positions is again accomplished by hydraulic means using pressurized engine oil. U.S. Pat. Nos. 4,721,073, 4,809,650, 4,834,031, 4,864,975 and 4,934,347 follow, improving on the same principle.

U.S. Pat. No. 4,864,977 uses an external source of hydraulic pressure and external timing equipment for switching between two pre-set heights of the two-part piston.

SUMMARY OF THE INVENTION

The relative position of the two parts of a telescoping piston is fully controlled outside of the engine by means of controlled engine oil pressure going to the crankshaft. A timing device is located at the crankshaft end of the connecting rod of each piston; once per each engine cycle, it opens the oil passage for a short period. Compression ratio control is accomplished by balancing the piston-positioning forces for this short period during the course either of the suction or compression stroke such that a definite amount of oil is locked in for the rest of the cycle.

In one of the embodiments, the passage opens in the middle of the suction stroke. During this "time window", the externally controlled hydraulic pressure is balanced against the cylinder pressure (vacuum) opposed by spring tension. Consequently, the piston crown incrementally assumes the appropriate position relative to the piston base which is engaged with the piston pin.

In the preferred embodiment, the oil passage opens in an advanced phase of the compression stroke and the cylinder pressure is balanced against the externally controlled hydraulic pressure which is augmented inside by inertial forces.

The timing device consists of a set of small valves (ball- or poppet-type) operated by the inertial forces generated at the crankshaft end of the connecting rod. With respect to the oil flow, these valves are arranged in series and on different timing given by their angular orientation; the oil passage is open just during the opening overlap of these valves and remains closed for the rest of the 720 deg cycle.

DESCRIPTION OF THE EMBODIMENTS

FIGS. 1 through 5 show examples of the invention; a number of similar arrangements and combinations of concept elements are possible by using the same principle. Both the drawings and the description mention only the features needed for explanation, most of the obvious details are left out. The words "horizontal", "vertical", "upper", "lower" etc. refer to a vertical cylinder although the functioning of the principle does not depend on the gravitational force and, therefore, the arrangement according to the invention is not restricted to the vertical cylinder position. The numbers in the descriptions serve for illustration. Their optimum values must be determined for each individual engine model.

Figure 6:
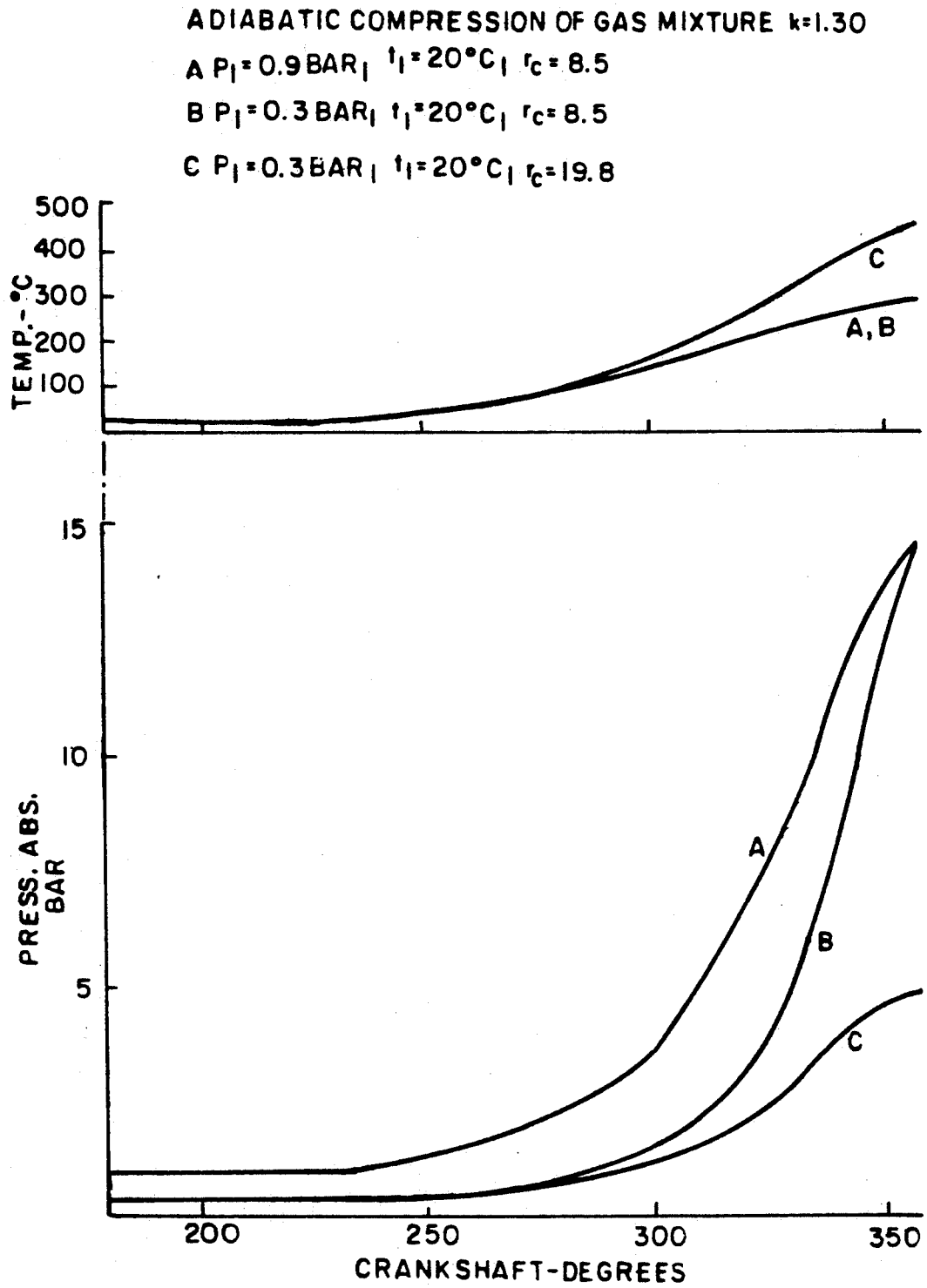
FIG. 6 is an idealized diagram of a gas similar to the air-vaporized fuel mixture, illustrating the basis for the choice of timing in the preferred embodiment of the invention.

FIG. 6 illustrates what can be accomplished by controlling the compression ratio. Curve A represents the idealized plot of the course of adiabatic compression of a full charge of gas mixture ($k=1.30$), depending on the angular position of the crankshaft (0 deg= =720 deg= top dead center at the beginning of the suction stroke for a four-stroke engine). Curve B shows the compression course of ⅓ of that full charge at the same compression ratio of $r_c=8.5$. Curve C then shows that with this partial charge in a throttled engine, the compression ratio could be raised to $r_c=19.8$ until the peak pressure would reach the same value as with the full charge at the basic compression ratio.

1. First Embodiment

Figure 1:
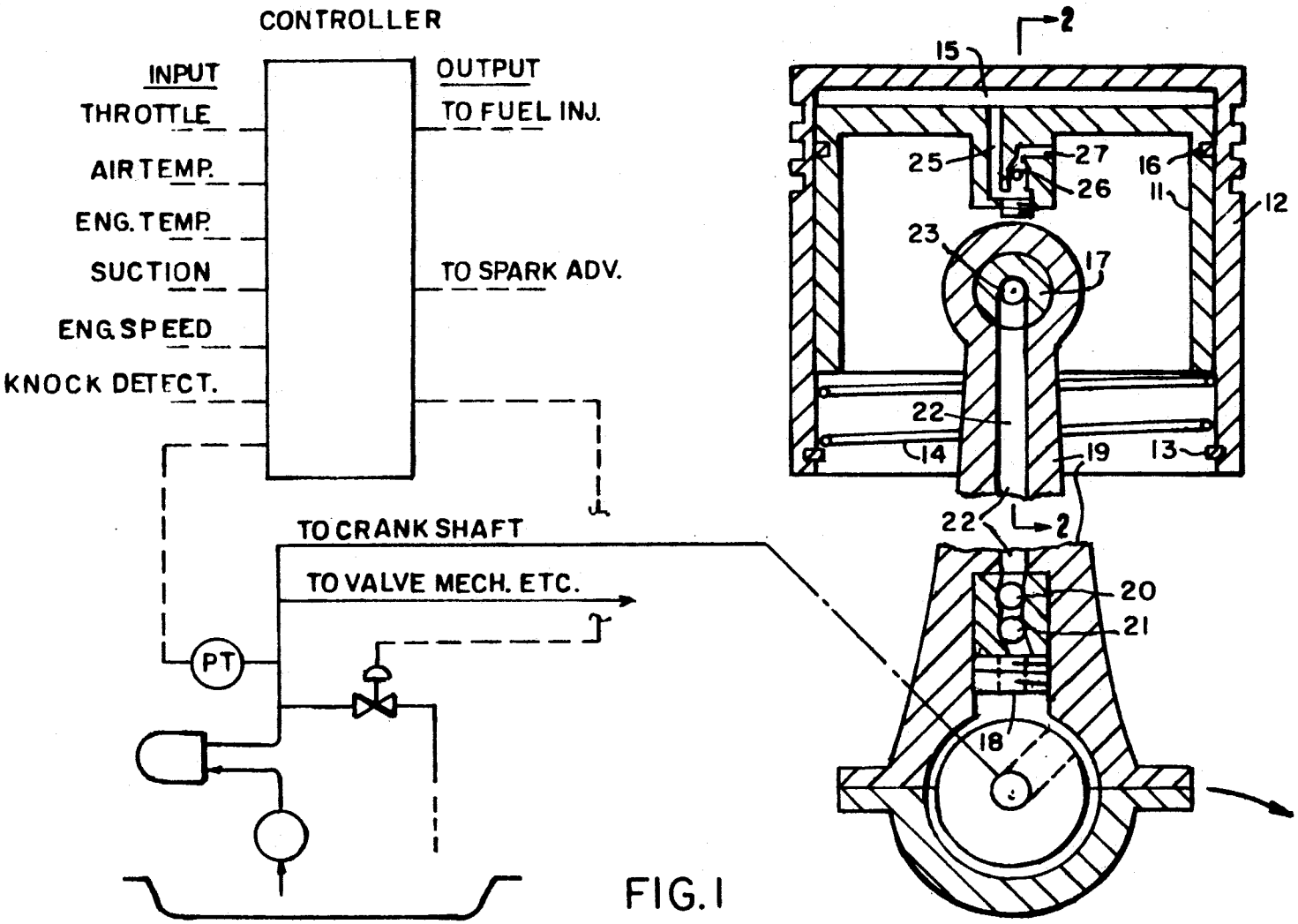
FIG. 1 is a cross-sectional view of the first embodiment, giving a simplified schematic outline of the control system.
Figure 4:
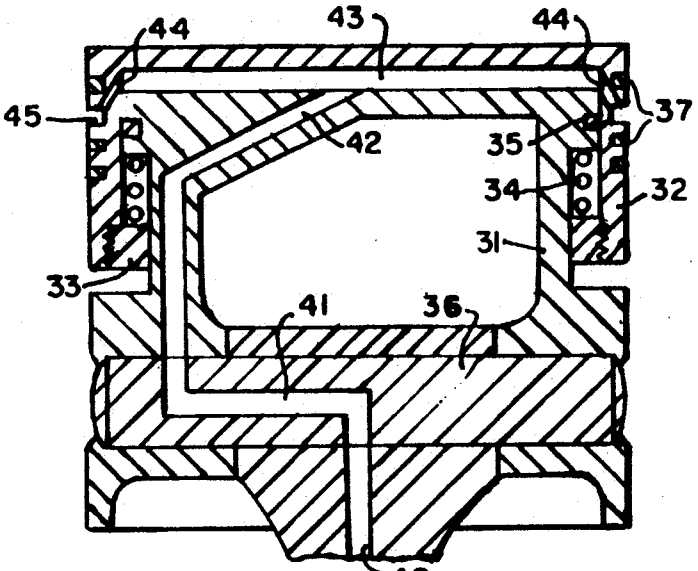
FIG. 4 is a cross-sectional view of the piston assembly taken along line B—B' of FIG. 3.
Figure 2:
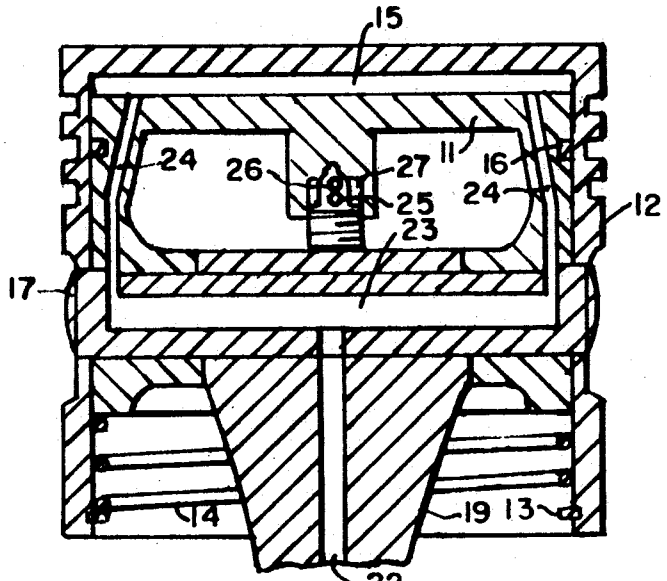
FIG. 2 is a cross-sectional view of the piston assembly taken along line A—A' of FIG. 1.

FIGS. 1 and 2 show the two-part piston consisting of a piston base 11 and piston crown 12 engaged movably together with a retainer 13 and a spring 14, so as to form a hydraulic chamber 15 sealed by a hydraulic piston ring 16. Controllably pressurized engine oil is introduced to a channel 18 in a connecting rod 19 connecting the piston to a crankshaft of an engine, in the usual fashion via crankshaft oil bores and piston rod bearings. An inertial valve 20 is positioned inclined by 10 deg from the vertical so as to tend to open from 640 to 100 deg, utilizing that component of the centrifugal force which is parallel to the direction of the valve seat axis. It will open just during the exhaust-suction stroke; it acts as a check valve for the rest of the cycle, the ball being forced against the seat either by high internal hydraulic pressure (during the compression-expansion stroke) or by inertial force. The valve 21 is positioned at an angle of 160 deg with respect to valve 20 so as to open at 80 deg and close at 260 deg.

Equalizing takes place in the close vicinity of 90 deg crankshaft position (in the middle of the suction stroke) during the opening overlap of the two valves. At that point, the vertical inertial (acceleration) force acting upon the piston assembly passes through zero value, and the only remaining vertical force—the upward cylinder suction pressure—is to be balanced by the difference of downward spring tension and upward hydraulic pressure. The oil proceeds to/from the hydraulic chamber 15 via channels 22, 23 and 24 extending through the connecting rod 19, the piston pin 17 and the piston base 11. Channels 25 and 27 and a small inertial valve 26 in the piston base 11 facilitate piston cooling by allowing controlled periodical ejection of the oil from the hydraulic space. Besides cooling the piston crown 12, this prevents the oil from being dead-ended, which might otherwise cause its thermal degradation.

In this embodiment, the piston positioning relies mainly on the spring tension while the oil pressure is controlled within a relatively narrow range.

2. Preferred Embodiment

FIGS. 3 and 4 show again a telescoping piston assembly consisting of a piston base 31, piston crown 32, retainer 33, retainer spring 34, hydraulic piston ring 35, piston pin 36 and compression piston rings 37. An enhanced role is assigned to the oil pressure control. The oil from the crankshaft oil bores enters the valve assembly 50 through the passage 38 and proceeds to/from the hydraulic chamber 43 through passages 39, 40, 41 and 42. Equalizing takes place when the piston is in the close vicinity of the spark ignition point, where the cylinder pressure is determined by the crankshaft angle, the charge size and by the piston height. The steep pressure rise (caused by combustion) has not yet started.

Figure 5:
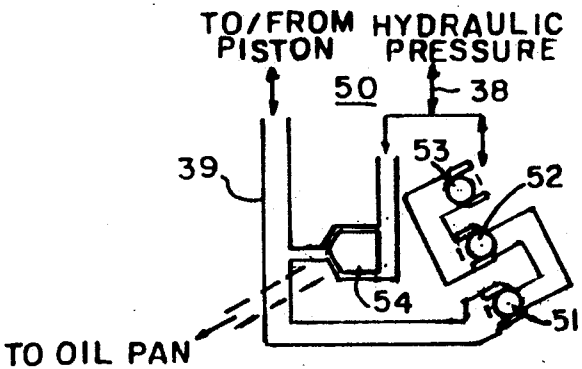
FIG. 5 is a schematic diagram of the timing device; it also shows a quick-return valve for prompt lowering of the piston crown.

FIG. 5 shows an arrangement of three valves in series. In order to facilitate understanding, this is a schematic diagram showing the axes of all valves in the same plane perpendicular to the crankshaft; it should be understood that a more compact design shall be accomplished in an actual three-dimensional layout. Valves 51 and 52 open from 160 to 340 deg, valve 53 from 320 to 500 deg so that there is an open passage during the overlap from 320 to 340 deg. On the next turn (at 680 deg) the valve 53 remains closed because of the high pressure difference between the two sides of the valve seat. Compared to the first embodiment, the third valve (52) actually doubles valve 51, but with the opposite flow direction so as to act as a check valve and to prevent valve 51 from being forced open by the hydraulic pressure in the later phase of the expansion stroke.

As can be seen in FIG. 6, at 330 deg crankshaft position (in the middle of the "window") the curves B and C are separated enough to ensure good sensitivity of the cylinder pressure to the height of the positioned piston crown. If the hydraulic piston diameter is 90% of that of the working piston, the range of the needed hydraulic pressure would be about 6–11 bar at a very low engine speed. This is to be corrected by the retaining spring tension, and the momentary inertial force acting upon the piston crown and upon the mass of the oil contained in the entire hydraulic space between the crankshaft and the piston crown 32. It is mainly the fluid column contained in the channel 40 that, at the actual engine speeds, greatly reduces the pressure requirement on the oil supply system. Further reduction can be achieved by backward shifting the equalizing point, however, this may be at the expense of the positioning accuracy. The desirable piston height adjustment range is about 8% of the stroke length in an atmospherically aspirated engine, larger in supercharged engines.

Figure 3:
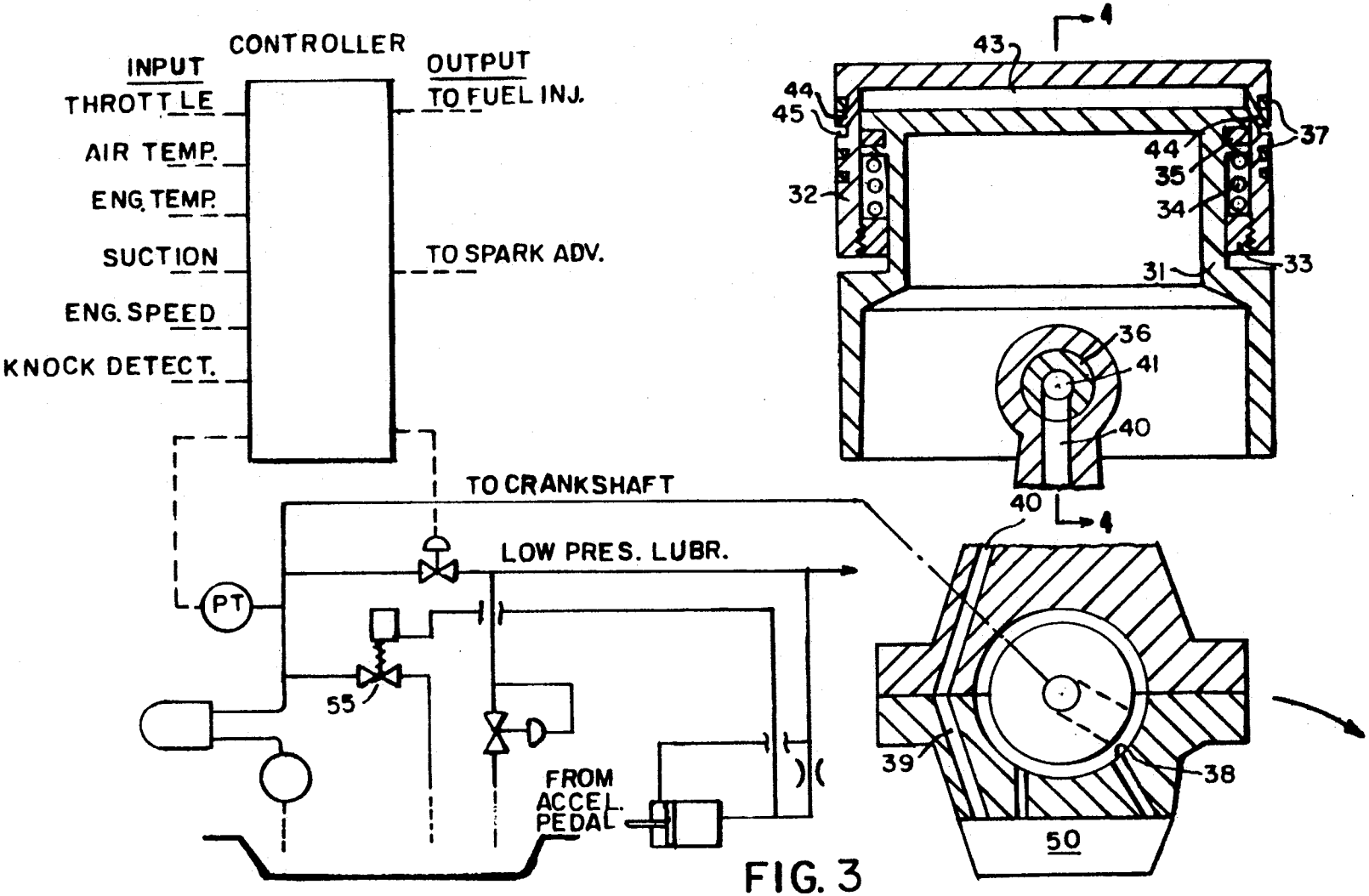
FIG. 3 is a cross-sectional view of the preferred embodiment, again presenting a simplified schematic outline of the control system.

FIG. 3 also shows a simplified schematic of the hydraulic pressure control system including a knock sensor signal; its incorporation makes possible optimizing programming for ultimate fuel utilization under most operating conditions, even with varying fuel quality. The computing controller is programmed for periodical step-wise or gradual upshifting of the pressure set point in order to "feel" the engine knocking threshold, and to maintain the compression ratio reasonably close below it. The hydraulic pressure control program must ignore short-lasting drops in suction pressure, such as during gear shifting; otherwise, the following quick suction pressure rise would result in engine knock before the piston could resume the appropriate lower position. Generally, there is no hurry for raising the piston crown but its quick return to a lower position is a must.

As to the hydraulic pressure mentioned above, higher pressure is needed with a larger cylinder charge, and vice versa. When the charge is increased, the cylinder pressure acts upon the piston crown in the favorable direction by starting immediately to lower it, even before the control circuit can respond. However, the valves 51, 52 and 53, which are on short timing, would not be able to pass the fluid and lower the piston crown fast enough in case of rapid depression of the accelerator pedal. For that purpose, FIGS. 3 and 5 show knock-preventing provisions consisting mainly of valves 54 and 55. Under normal operating conditions, the valve 54 remains closed, its piston being pushed against the seat by the hydraulic pressure; the piston diameter is at least 4 times as large as the seat bore so that the valve can hold even the peak combustion pressure transmitted to the hydraulic chamber 43. Rapid accelerator depression opens the valve 55 which dumps the oil pressure promptly and, consequently, opens all valves 54 (in a multi-cylinder engine). As an example of a simple mechanism which would accomplish that, a hydraulic cylinder/plunger/orifice assembly is shown (actuated by the gas pedal) which creates enough pressure for opening the valve 55 just when the plunger is moving fast; the system will ignore moderate depression of the accelerator pedal. Alternately, the same can be accomplished via electronic control of the valve 55.

The increased prevailing peak pressure raises another concern. Without any provision, the increased blow-by and crevice loss would partially offset the thermodynamic gain. Since the pressure pulsations in the hydraulic space are synchronous with the cylinder pressure, gas leakage can be countered by this hydraulic pressure channeled through 43 into a circular distributing groove 45 between the compression rings 37 of the piston crown, thereby forming a cyclically pressurized liquid seal and, at the same time, eliminating some of the crevice volume. The lower compression ring is designed with increased side clearance; it moves within the groove upon each piston stroke and releases small amounts of oil from the hydraulic space in order to secure piston cooling.

What is claimed is:

1. A variable compression piston assembly for a gasoline engine comprising a piston crown adapted for mounting in the cylinder of a gasoline engine and defining therein a cylindrical opening, a piston base movably disposed in said cylindrical opening in sealing relationship therewith and forming a sealed chamber with said piston crown, a connecting rod pivotally mounted at one end to said piston base by means of a piston pin and being adapted to be mounted at its other end to the crankshaft of the gasoline engine, passage means in said connecting rod and said piston base for supplying hydraulic fluid from a pressurized fluid source from said crankshaft to said sealed chamber and (valve means) a set of serially arranged valves (arranged) in said connecting rod at the other end thereof, said valves being operable by orbital inertial forces and being oriented in said passage means so as to open said passage means during a predetermined angular position interval of said crankshaft.

2. A piston assembly according to claim 1 wherein said angular interval is in the middle of the suction stroke.

3. A piston assembly according to claim 1 wherein said angular interval is in an advanced phase of the compression stroke.

4. A piston assembly according to claim 1, wherein control means are provided for upshifting the hydraulic fluid pressure so as to increase engine compression to approach an engine knocking threshold and to maintain the hydraulic pressure near such threshold.

5. A piston assembly according to claim 1, wherein said piston crown has a plurality of seal rings and a circumferential groove arranged between said seal rings and in fluid communication with said sealed chamber so as to supply pressurized fluid from said sealed chamber to said groove.

6. A piston assembly according to claim 5, wherein the seal rings of said piston crown on one side of the groove remote from the piston crown top are disposed on said piston crown with larger clearance than any seal ring on the other side of said groove so as to permit some pressurized fluid release from said sealed chamber.

7. A piston assembly according to claim 1, wherein means are provided in communication with a pressurized fluid supply line for dumping the pressurized fluid under sudden high load operating conditions.

8. A piston assembly according to claim 1, wherein the serially arranged valves in said passage means have different opening periods given by their different angular orientation with respect to a central axis of the connecting rod and providing a time interval of open passage to the hydraulic fluid source once per cycle during their opening overlap.

* * * * *